United States Patent [19]

Marshall et al.

[11] Patent Number: 4,549,387

[45] Date of Patent: Oct. 29, 1985

[54] FLEXIBLE CONTAINER FILLING APPARATUS

[75] Inventors: Stephen Marshall, Patterson Lakes; Hung D. An, Oakleigh, both of Australia

[73] Assignee: ACI Australia Limited, Victoria, Australia

[21] Appl. No.: 511,203

[22] Filed: Jul. 6, 1983

[30] Foreign Application Priority Data

Jul. 7, 1982 [AU] Australia ..... PF4753
Jun. 15, 1983 [AU] Australia ..... PF9813

[51] Int. Cl.[4] ..... B65B 3/17; B65B 51/14

[52] U.S. Cl. ..... 53/469; 53/479; 53/266 R; 53/570; 53/373

[58] Field of Search ..... 53/469, 479, 266 R, 53/373, 390, 202, 570, 282, 300, 381 A

[56] References Cited

U.S. PATENT DOCUMENTS 3,220,161 11/1965 Lohse et al. ..... 53/373
3,309,837 3/1967 Faust et al. ..... 53/479
3,398,503 8/1968 Bertoglio ..... 53/570
3,447,281 6/1969 Buford et al. ..... 53/381 A X
3,619,975 11/1971 Johnson et al. ..... 53/570 X
3,956,873 3/1976 Kiener et al. ..... 53/373 X
4,003,188 1/1977 Lau ..... 53/570 X
4,174,599 11/1979 Callet et al. ..... 53/570 X
4,177,621 12/1979 Powell, Jr. ..... 53/469 X

*Primary Examiner*—Horace M. Culver
*Attorney, Agent, or Firm*—Cushman, Darby & Cushman

[57] ABSTRACT

Apparatus and method is provided for packaging a flowable material in bag containers. The apparatus comprises a support stand and, mounted thereon, a filling station, a sealing station, and support means, the stations being in spaced, side by side relation. The support means has a support surface on which successive containers are receivable, and which is movable relative to the stations from a position in which a container received thereon is presented in turn to the filling station and the sealing station. The filling station has a filler head connectable to a source of supply of the flowable material and engageable with an opening of the container for discharge of a quantity of the material into the container. The sealing station has sealing means for receiving the container opening, the sealing means being connected to an electric power source and being operable to grip the opening and form a heat seal thereacross.

35 Claims, 14 Drawing Figures

FLEXIBLE CONTAINER FILLING APPARATUS

This invention relates to an improved bag container for the packaging of flowable materials such as liquids, pastes or flowable particulates such as powders, and to a method of and apparatus for filling bag containers. For ease of such materials hereinafter are referred to as liquids.

A bag container according to the invention has at least two superimposed panels of plastics material, a first seam extending adjacent a first edge of and joining each panel, and two second seams each extending from the first seam adjacent to and joining respective second edges of said panels, said second edges extending from the first edges and said second seams defining an opening for the container.

The bag container may have more than two superimposed panels, such as four panels. In one form in which there are four panels, each outermost panel may be contiguous with the next inner panel along the one edge thereof.

The invention also provides a method of forming bag containers, which includes superimposing at least two panels of plastics material, and joining said panels by forming a first seam extending adjacent a first edge of each panel, and by forming two second seams each extending from the first seam adjacent to a respective second edge of each panel, said second edges extending from the first edges and the second seams defining an opening for the container.

Where the container has four superimposed panels, each outermost panel may be contiguous with the next inner panel along edges thereof remote from the first edges and extending between the respective second edges. In such case, the container opening is bounded by those contiguous edges.

While reference is made to a first seam and to respective second seams, it is to be understood that each of these seams may comprise respective parts of a single, continuous seam. Thus, while the step of seaming may be performed in two operations in one of which the second seams are formed and in the other of which the first seam is formed, the step can also be performed in a single operation.

The second seams may terminate at or adjacent said contiguous edges. To facilitate filling of the container, the second seams most conveniently converge adjacent the contiguous edges to provide a relatively narrow opening for the container. Such convergence can result from one or each of the second seams having a section thereof which extends away from its side of the container, toward the other second seam, to thereby join all four panels along a line at or adjacent those contiguous edges. Such second seam section can be spaced from the contiguous edges and, in such case, may be provided with an end portion which, with the other second seam, defines the container opening as a short tube extending outwardly in the direction of the other second seam. Alternatively, such second seam section can be provided at or relatively close to the contiguous edges and, in that case, it may be provided with an end portion which, with the other second seam, defines the container opening as a short tube extending inwardly in the direction of the other second seam.

The container can be formed from two sections of sheet plastics material. In one arrangement, one section can be positioned over the other, and the two sections can be separately folded and one then positioned over the other with the respective fold lines adjacent, to provide four panels. In each of these cases, the respective sections of plastics material most conveniently are of elongate strip form, such that successive containers can be produced in automatic machinery; the second seams being formed transversely with respect to the sections and separating successive containers. The latter can be severed from each other by the seaming operation or by a cutter device. In each of these arrangements for severing successive containers, a seaming device for forming the second seams along adjacent sides of successive containers can be operable to form a single seam which is severed longitudinally by that device or a cutter device so that a respective portion of the single seam defines a respective second seam at each of the adjacent sides. Alternatively, such seaming device may simultaneously form two closely parallel seams, each providing a respective second seam, with the seaming device or a cutter device severing the successive containers between the parallel seams. In a further alternative, the seaming device may be operable to form such single seam or to simultaneously form such parallel seams, with perforating means being operable to provide a line of weakness along that single seam or between said parallel seams; the line of weakness enabling a container to be torn from the next successive container as required. In that further alternative, the containers can be wound onto a spindle to form a roll thereof, such as to be mountable at a work station to enable each successive container, as required for use, to be drawn from the roll and torn off along the line of weakness between it and the next container.

In a further alternative suited to production by automatic machinery, the containers can be formed from tubular plastics material. In a first arrangement, two tubes of such material can be used; each of those being flattened and one then placed on the other. In a second arrangement, a single flattened tube can be used, this then being folded along its longitudinal centre-line. In the first arrangement, the first seam is provided at or near adjacent longitudinal sides of the respective flattened tubes. In the second arrangement, the first seam most conveniently is provided along the centre-line of the single tube, i.e. at the side resulting from folding that tube. In each arrangement, the second seams and severing of, or formation of a line of weakness between, the containers can be provided as described in the immediately preceding paragraph.

The invention additionally provides apparatus for filling a bag container, such as a container as herein provided. The apparatus has a filling station at which filling of successive bags with a liquid can be affected. The filling station may include a filler head engageable with an opening of the container for discharge of liquid to the latter. The filler head may have a nozzle onto which the container opening is receivable. In one arrangement, the nozzle is of elongate tubular form and has a plunger movable axially therein between a position in which it closes an outlet of the nozzle, and a retracted position clear of that outlet to permit discharge of liquid to a container. Such plunger may be movable under the action of actuator means, such as a hydraulic or pneumatic ram of which the plunger can form the piston rod. Such ram may be single acting and operable against the action of biasing means urging the plunger to its closed position, or it may be double acting.

The filling head may include gripping means for engaging the container adjacent its opening and securing the container in a filling position. Thus, where the filling head has a nozzle, the gripping means may comprise at least one block member movable between a retracted position and a position in which it clamps the container on the nozzle. The or each such block member may be movable under the action of actuator means, such as a cam member operable to move the block member to its clamping position against the action of means which biases that member to its retracted position.

The filling station may include control means enabling operation of one or more of the components thereof. Thus, the control means may include means for energizing a device, such as an electric motor, controlling operation of a pump for supplying liquid to the filling station and/or a control device, such as a solenoid, for controlling operation of an actuator of the filling head, such as the actuator for the nozzle plunger. Also, while the above-described cam member for moving the gripping means may be manually operable, it can alternatively be operated by an actuator energized by the control means.

Liquid with which a container is to be filled may pass to the nozzle from a suitable source, via supply line. Flow measuring means, such as a turbine flow meter, can be provided in that line and operated under the action of liquid flow to generate a signal which is passed to the control means. By monitoring that signal, the control means may be operable to terminate a filling operation when a predetermined quantity of liquid has been charged to a container. Additionally, the control means may have read-out means, such as an L.E.D. display, to provide an indication of that quantity for successive individual containers and/or an aggregate quantity for successive containers.

The apparatus has a sealing station which includes sealing means positioned to receive successive filled containers from the filling station for sealing of the opening of each container. The sealing means may include a welding block and a pressure block; the blocks being relatively movable between a retracted position in which to receive the opening of a container therebetween and a closed position for effecting a sealing operation across that opening. Supply of electric power to, and resultant heating of, the welding block enables sealing of the container opening.

The sealing station may include an actuator for effecting relative movement between the welding block and the pressure block. In one arrangement, the actuator may be a hydraulic or pneumatic ram, such as a single acting ram operable against the action of biasing means urging the blocks to their retracted relative position, or a double acting ram.

The above mentioned, or a further, control means may be provided to control operation of the sealing means. In one convenient arrangement, the control means is operable to provide time-controlled actuation of energizing means enabling a sealing operation to be performed. Thus, the control means may be operable to energize a control device, such as a solenoid, to effect movement of the welding and pressure blocks of their closed position for sealing of the opening of a container received between those blocks. The control means also may be operable to actuate a power source for heating of the welding block for a predetermined interval and, after a predetermined further interval sufficient for cooling of a resultant sealing weld, to permit movement of the blocks to their retracted position.

The apparatus may include means for supporting successive container at the filling and sealing stations. The support means may comprise a support platform on which a container to be filled is receivable. Most conveniently, such platform is inclined downwardly from the filling and welding stations such that a container can be positioned with its opening above the body of the container. The platform may have a lip across a lower edge thereof, so as to support the bottom of the container and the weight of liquid received therein. Such lip may be pivotable between an upwardly extended position and a position in which it provides a continuation of the platform beyond the lower edge of the latter, to facilitate discharge of a filled and sealed container from the platform, such as to a conveyor or wheeled pallet. A detent device, operable to releasably hold the lip in its upwardly extended position, may be provided adjacent the lower edge of the platform.

The apparatus may have means for moving successive filled containers from the filling station to the sealing station. In one arrangement, the moving means may comprise an endless belt indexable so as to move at successive intervals through a distance corresponding to that distance to be moved by a bag from the filling to the sealing station. Such belt most conveniently extends across a support means and the latter may be a platform as described in the immediately preceding paragraph.

In an alternative arrangement, the moving means may comprise means mounting to a support means as described in the penultimate paragraph for movement between respective positions in which a container supported thereon is adjacent the filling station and the sealing station. The mounting means may have at least one guide rail extending between these positions, and at least one carriage member engaged with the guide rail for movement therealong; the support means being secured to and movable with the carriage member.

Where the support means is an inclined platform as described above, a respective guide rail can be provided adjacent its lower and upper edges. In such case, there may be a respective pair of carriage members secured to each edge, the members of each pair being spaced along the rail and their edge of the platform. Movement of the platform between its respective position at each of the filling and sealing stations can be limited by stop means at each end of at least one of the rails, such as abutments on the rail engageable by one or a respective one of the guide members.

Apparatus as described in the foregoing can be used to provide efficient filling of containers, with only a single operator being required for its operation. In filling 10 liter containers, such apparatus can deliver 2 to 2.5, or more, containers per minute.

Such output of filled containers can be increased by an arrangement in which two such apparatus are provided in a back-to-back arrangement. With such dual arrangement, each apparatus may have a common or separate control means enabling operation of one or more components of the filling station of each; with that, or further common or separate control means controlling operation of the sealing means of each apparatus. With either common or separate control means, each apparatus can be synchronized such that one is in its filling cycle when the other is in its sealing cycle, and vice versa; thereby enabling a doubling of output compared with a single apparatus, but a reduced running cost due to only a single operator still being sufficient.

In a more practical dual arrangement, a preferred form of apparatus according to the invention has a filling station located intermediate two sealing stations, the filling station and each sealing station being as described above. Where the filling station includes control means, the latter may control operation of the sealing means of each sealing station. Alternatively, there may be separate or common further control means for the two sealing means. In each case, the arrangement most conveniently is such that while one sealing station is operable to seal a previously filled container, the next container is being filled at the filling station and, when the next container is filled, it then moves to the other sealing station for sealing. When the next container has been so moved, the previously filled container, then sealed, is discharged; and filling of a further container commences prior to its sealing at the one sealing station.

The apparatus described in the preceding paragraph most conveniently has supporting means as described above.

The support means may be indexable or movable for moving alternate filled containers to a respective sealing station; the first filled container, and each alternate one thereafter, passing to one sealing station, and the second and each alternate filled container thereafter passing to the other sealing station. Where the support means in an inclined platform having a lip across the lower edge thereof, as described above, the lip may comprise respective lip sections in end-to-end relation and each having a respective detent device such that a filled and sealed container at one sealing station can be discharged from that station while the next container is being supported at the filling station.

In the different forms of apparatus described above, the sealing means may comprise a pressure block and a welding block in side-by-side relation and opposed to a clamping block; the clamping block being movable relative to the pressure and welding blocks. With the clamping block retracted relative to the pressure and welding blocks and the opening of a container received between the relatively retracted blocks, the blocks may be moved to an operative position in which the container is gripped between the pressure and clamping blocks and also between the clamping block and the welding block; with the welding block being electrically heated to seal the container opening. The welding block may be fixed relative to the pressure block, or movable relative thereto. In one arrangement, the pressure block is fixed, with the clamping block movable between a retracted position spaced from the pressure block and a closed position in which it co-operates with the pressure block to grip a container received therebetween. In that arrangement, the welding block is oppositely movable with respect to the clamping block, between a retracted position remote from that block, and a closed position in which it co-operates with the clamping block to grip and seal a container opening received therebetween.

In the arrangements of the preceding paragraphs, the electric power supplied to the welding block can be regulated so as to maintain the temperature of that block substantially constant; thereby providing constant heat welding. Particularly where such welding conditions are utilized, the pressure block and/or the clamping block can be hollow and connectable to a source of cooling fluid, such as water, to enable circulation of such liquid therethrough and maintenance of a substantially uniform temperature in each of these blocks. Also, an insulating layer of a heat resistant material can be provided over the clamping block, to minimise heat transfer to that block from the welding block during a welding operation. Preferably such material is resilient so as to ensure uniform pressure is applied by the welding head in a welding operation.

The or each welding station may include cooling means for cooling a seam freshly formed across the opening of a container, prior to release of the container from that station. In the above described form of sealing means having pressure, clamping and welding blocks, a container may be held by the pressure and clamping blocks after completion of a welding operation and retraction of the welding block. In such arrangement, cooling means may comprise gas distribution means mounted on or adjacent one of the pressure and clamping blocks and adapted to discharge over the hot seam, as exposed on retraction of the welding block, a stream of cooling gas, such as air, received by the distribution means from a suitable source.

Reference now is directed to the accompanying drawings, in which.

Figure 1A:
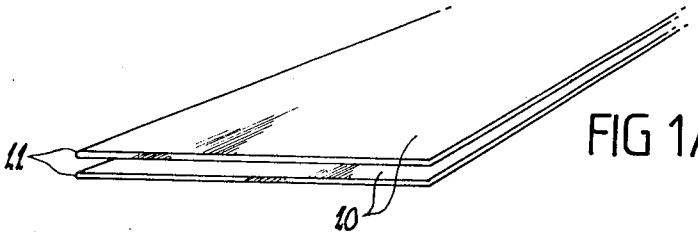
FIGS. 1A, 1B and 1C are perspective views of respective forms of sheet material for use in producing bag containers.
Figure 1B:
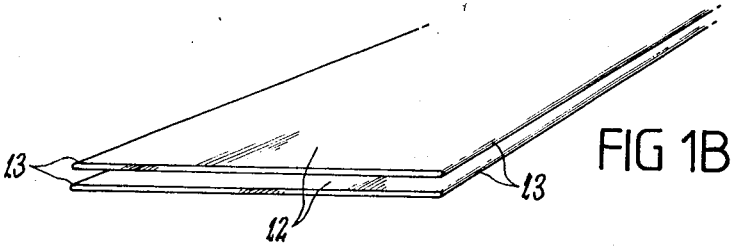
Figure 1C:
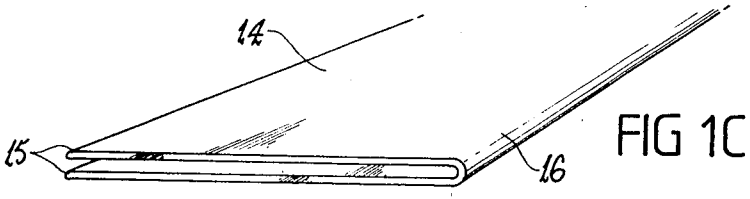

In FIGS. 1A to 1C, the sheet material may be a thermoplastic, or a laminate material having a thermoplastic film on adjacent surfaces. In each case, the material is arranged to provide four layers which overlie each other to produce a bag container having four panels.

In FIG. 1A, there are two elongate strips 10 of the material, each folded on its longitudinal centre-line. One strip overlies the other with the folds 11 adjacent.

In FIG. 1B, there are two elongate flattened tubes 12 of the material. One tube overlies the other with each of its folds 13 adjacent a respective fold of the other.

FIG. 1C shows a variant of FIG. 1B. In this, a single tube 14 is flattened to provide side edge folds 15 are adjacent, and to provide a fold 16 at the other side of the resultant strip.

Figure 2:
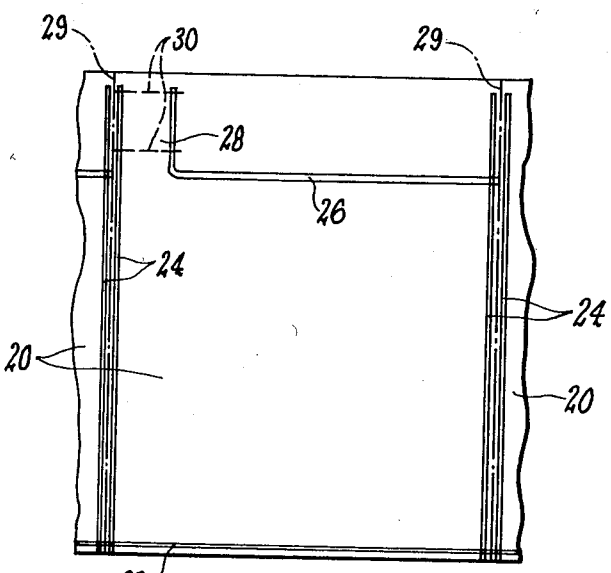
FIG. 2 shows a bag container produced from such material.

A bag container 20, as shown in FIG. 2, can be produced from material arranged as in any one of FIGS. 1A to 1C, in which case it has four panels overlying each other. Alternatively, container 20 can be formed from two single thickness strips of single thickness material and in this case, the container has two panels. The panels are secured together by a first seam 22 extending across one side of container 20, respective second seams 24 extending from seam 22, and a third seam 26 extending across the top of container 20 from one of seams 24 to define with the other seam 24 an opening 28 for the container. Seams 22,24 and 26 can be separate, as shown, or they can be sections of a single seam.

Where container 20 is produced with the arrangement of FIG. 1A, seam 22 most conveniently is provided along and joins the four adjacent edges remote from folds 11. In use of the arrangement of FIG. 1B, seam 22 can extend along one or other pair of respective adjacent folds 13. In use of the arrangement of FIG. 1C, seam 22 most conveniently extends along fold 16. In each of these cases outlet 28 is bounded by a fold at which each outermost panel is contiguous with the respective inner panel.

Each of seams 22,24 and 26 can be formed by a heat sealing operation. Most conveniently, reptition of that operation at intervals along the elongate material provides successive, adjacent containers 20 which then can be severed from each other. Adjacent containers, as produced, may be spaced between respective seams 24 and severed by a cutting device passed between those seams along line 29. Alternatively, the seaming device producing seam 24 may be operable in the seaming step for severing successive containers.

A bag container can be used for the packaging of a wide variety of liquids, such as battery acid, milk and wine. It also can be used for flowable food preparations, such as cake or batter mixes. With suitable gauge material, such container can enable such materials to be packaged and safely handled in quantities of 10 or 20 liters or more.

The container, when filled, can be readily sealed by forming a seam, or a pair of seams across opening 28, such as shown by broken lines 30. As indicated, seam 26 is spaced inwardly from the adjacent side of the container and opening 28 is of tubular form; being defined by a terminal portion of seam 26 and the other seam 24. The contents of the container can be discharged after simply cutting across opening 28, interiorly of or across the seam(s) 30.

Figure 4:
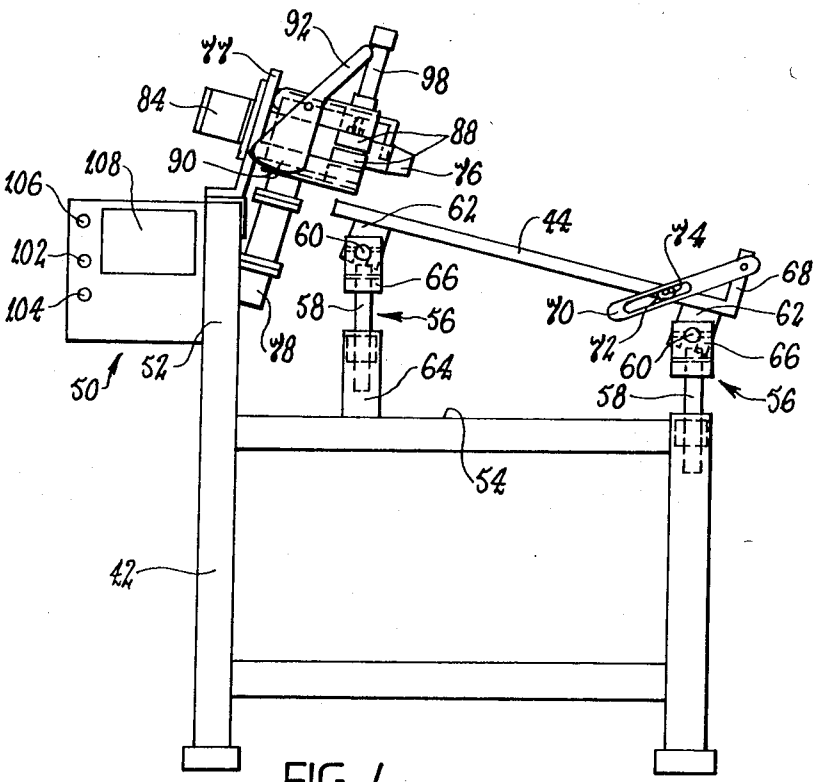
FIGS. 3 to 5 show in front elevation, side elevation and plan view from above apparatus for filling and sealing bag containers.
Figure 3:
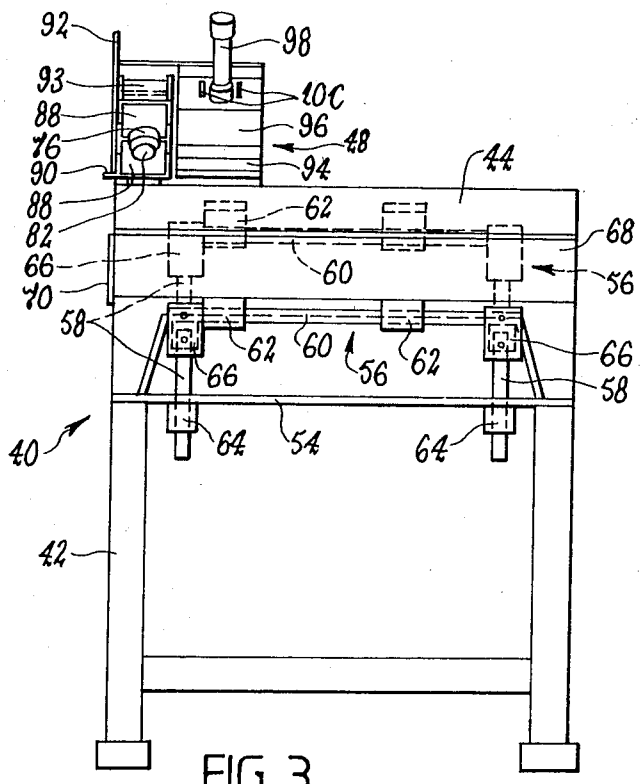
Figure 5:
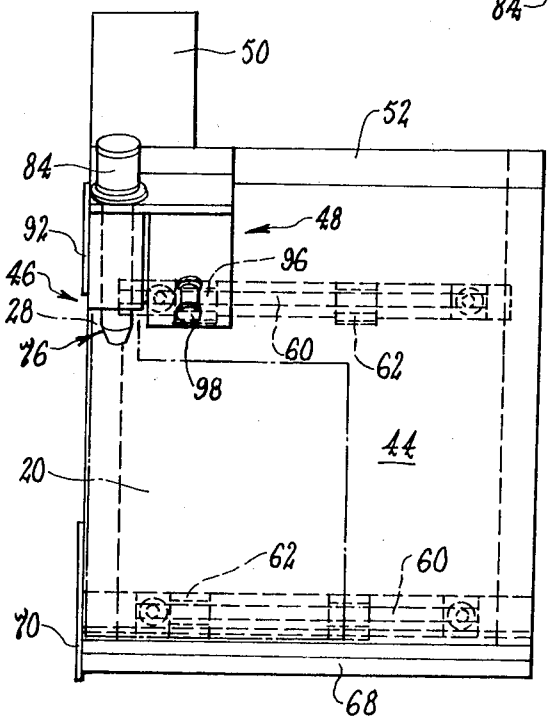
Figure 7:
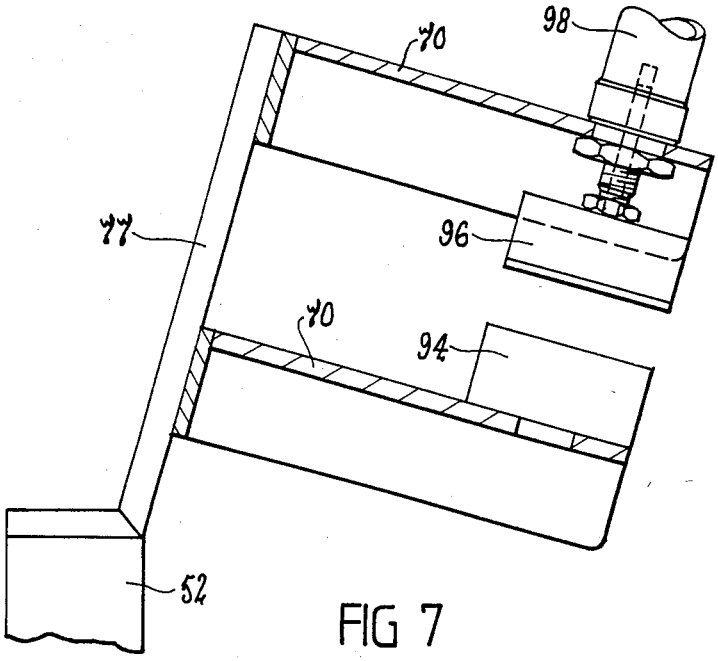

With reference to FIGS. 3 to 5, the apparatus 40 has a stand 42 on which is provided a container support platform 44, filling and sealing stations 46 and 48, and control unit 50. Stand 42 is rectangular or square in plan view, with stations 46,48 being provided on a rigid rear member 52 above horizontal support table 54.

Platform 44 is mounted on table 54 so as to incline downwardly from stations 46,48 to its forward edge. A container such as shown in FIG. 2 thus can be received on platform 44 with its opening adjacent the stations and at a higher level than the body of the container, to facilitate filling and sealing operations.

The inclined mounting of platform 44 is provided by forward and rear mounting assemblies 56. Each of the latter includes a pair of vertical rods 58 spaced laterally of stand 42, a guide rail 60 extending between the upper end of rods 58, and a pair of carriage members 62 secured to platform 44 and slidable along rail 60. The lower end of each rod 58 is received in a support block 64 mounted on table 54. The rear ones of blocks 64 project above the forward ones so that the generally inclined disposition of platform 44 is provided. However, each rod 58 is longitudinally adjustable in its block 64, such as by screw-threaded engagement or a locking screw, to enable adjustment of the inclination of platform 44.

The upper end of each rod 58 has mounted thereon an enlarged block 66. The blocks 66 each have a transverse bore through which rail 60 extends. Also, carriage members 62 are in the form of a yoke; having spaced legs which straddle rail 60. Members 62 and, with them, platform 44 are movable between left and right hand extreme positions, with a respective block 66 serving as a stop for the platform in each of these positions by engaging a carriage member 62.

Figure 8:
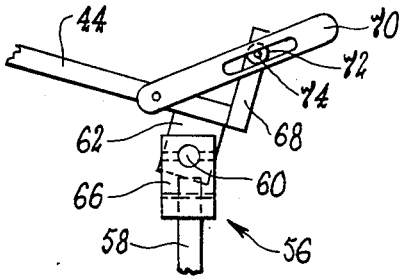
FIG. 8 shows a modified arrangement for one component of that apparatus.

Across the lower, front edge of platform 44, there is a lip 68 which is pivotable from the upstanding position shown to a position in which provides a continuation of platform 44. A flat bar 70 pivotably mounted at one end of lip 68 holds the lip in the former position, by tooth 72 engaging pin 74 on platform 44. Lifting of bar 70 so that tooth 72 clears pin 74 enables lip 68 to move to its latter position. A converse mounting arrangement for bar 70 is shown in FIG. 8.

Figure 6:
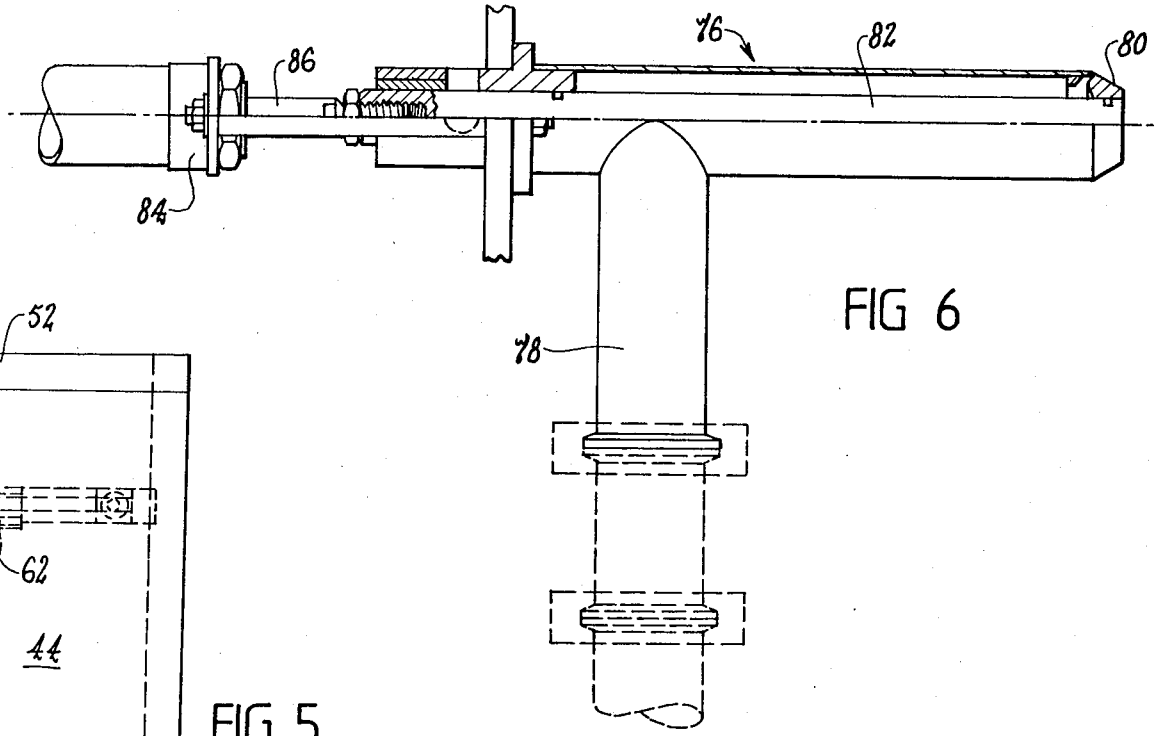
FIGS. 6 and 7 show in larger detail, components of that apparatus.

Filling station 46 includes a filling nozzle 76 mounted on bracket 77 of stand 42 and over which the opening of a container can be fitted. The container then can be filled by material supplied to nozzle 76 from a source, via duct 78. As shown in FIG. 6, nozzle 76 has an outlet 80 and encloses a piston 82 movable axially therein between a forward position in which it closes outlet 80 and a retracted position providing communication between duct 78 and outlet 80. This movement of piston 82 is effected by operation of pneumatic cylinder 84, the piston 86 of which is connected to piston 82.

Station 46 also includes on bracket 77 a pair of gripping blocks 88 mounted on opposed sides of nozzle 76. Blocks 88 are movable twoards each other by the action of cam 90 on pivoting of cal lever 92, and away from each other under the action of a return spring 93. In the former position, blocks 88 grip a container received on nozzle 76 to secure the container during a filling operation.

Sealing station 48 has lower and upper blocks 94,96 mounted on brackets 79; the latter projecting forwardly from bracket 77. Lower block 94 is a welding block connected to a source of electric power, while upper block 96 is a pressure block movable toward and away from block 94 for gripping and releasing, respectively, the opening of a container received therebetween. Movement of block 96 toward block 94 is effected by air cylinder 98, while return movement can also be by cylinder 98 or a return spring (not shown). Block 96 is guided in its movement by guide pins 100 which project upwards therefrom through openings in bracket 79 on which block 96 is mounted.

Control unit 50 is operable to control functioning of various components of the apparatus.

In use of apparatus 40, a container 20 to be filled is positioned on platform 44 with its opening 28 fitted over nozzle 76. The container then is secured by gripping blocks 88, by operation of cam lever 92. Control button 102 of unit 50 then is depressed to energize a control device, such as a solenoid, operable to retract piston 82 by operation of air cylinder 84. Liquid then is charged to the container from duct 78, via nozzle 76; the quantity of liquid being monitored by a flowmeter and magnetic probe in duct 78. A signal or pulses generated by the flowmeter/probe is received by control unit 50 and, when that signal or aggregate of pulses indicate a predetermined quantity of liquid has been charged to the container, unit 50 de-energizes the control device to close nozzle 76. Lever 92 then is returned to its initial position to open blocks 88.

The filled container then is ready for sealing. For the latter operation, the opening of the container is slid off nozzle 76 and held against discharge of liquid. Platform 44, when positioned for filling, has its left hand carriage members 62 against left hand blocks 66 (FIG. 3). To present the container opening to the sealing station, platform 44 is moved to the right until the right hand members 62 abut the right hand blocks 66. For sealing, control button 104 is depressed to energize a control device, such as a solenoid, operable to close pressure block 96 toward welding block 94, by operation of air cylinder 98, and grip the container opening between those blocks. Control unit 50 then actuates the power source for heating block 94 to perform a welding operation and, after a predetermined interval, unit 50 de-actuates that source. Unit 50 thereafter retains blocks 94,96 closed for a further time sufficient for cooling of the seal and then de-energizes the control device for cylinder 98 to open blocks 94,96.

During filling of a container, its movement from the filling station to the sealing station, and sealing, the weight of liquid is supported on lip 68. After sealing, bar 70 is lifted to release its tooth 72 from pin 74 and allow lip 68 to move to its lower position, and movement of the filled and sealed container under gravity down platform 44 to a conveyor or roller pallet.

Control unit 50 also includes a control button 106 depressible by an operator to terminate operation in the event of a malfunction, such as commencement of a filling or sealing operation without correct position of a container having been effected. Unit 50 also includes a read-out display 108 for showing the quantity of liquid charged to successive containers, the aggregate quantity and/or the number of containers filled.

Figure 9:
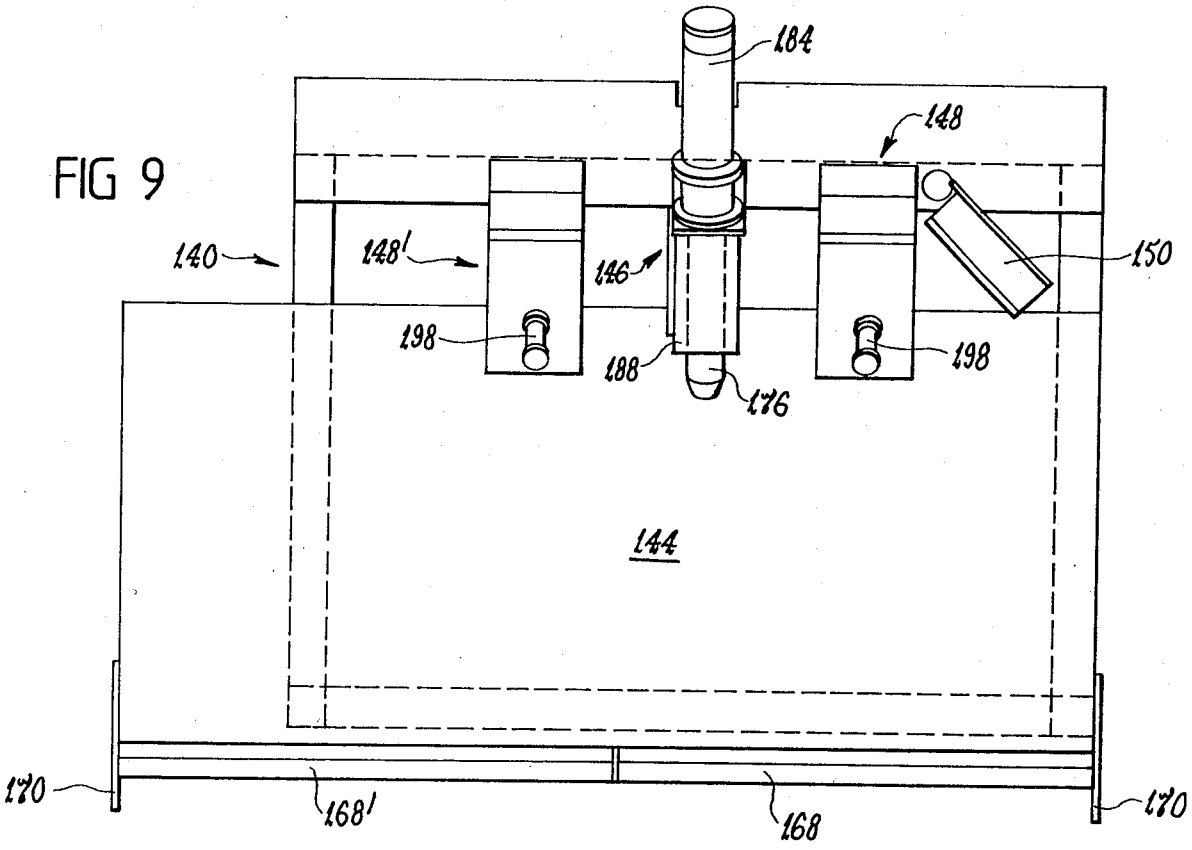
FIGS. 9 to 11 show in front elevation, side elevation and in plan view from above an alternative apparatus for filling and sealing bag containers.
Figure 10:
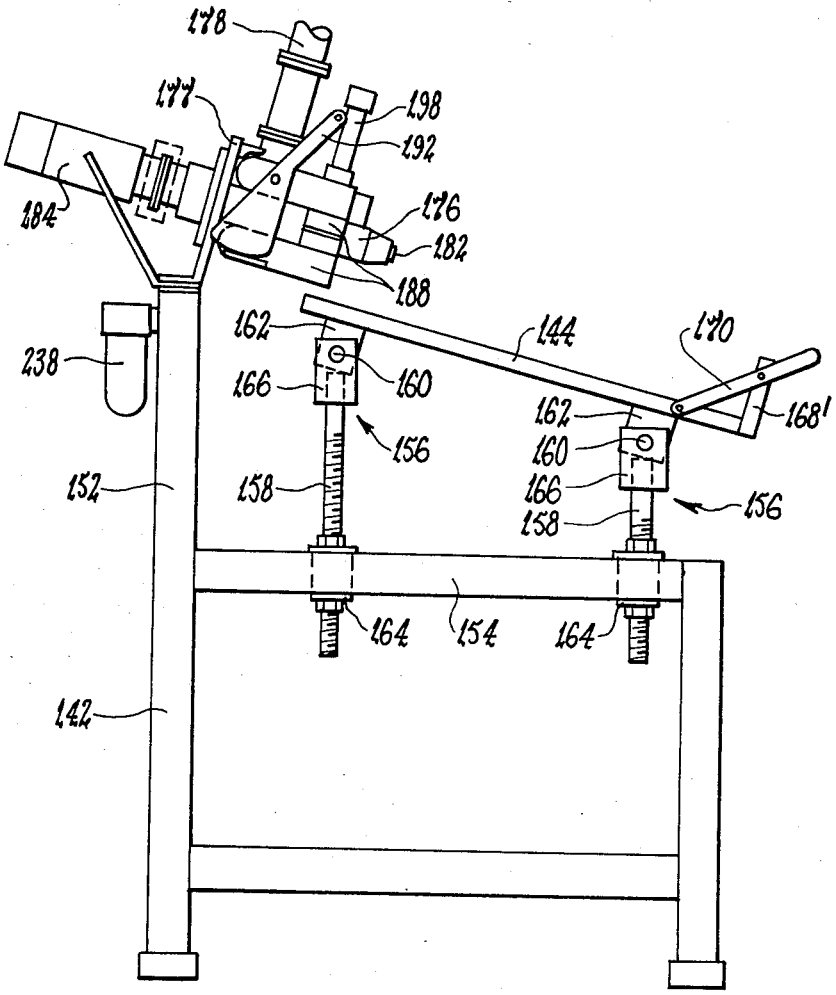
Figure 11:
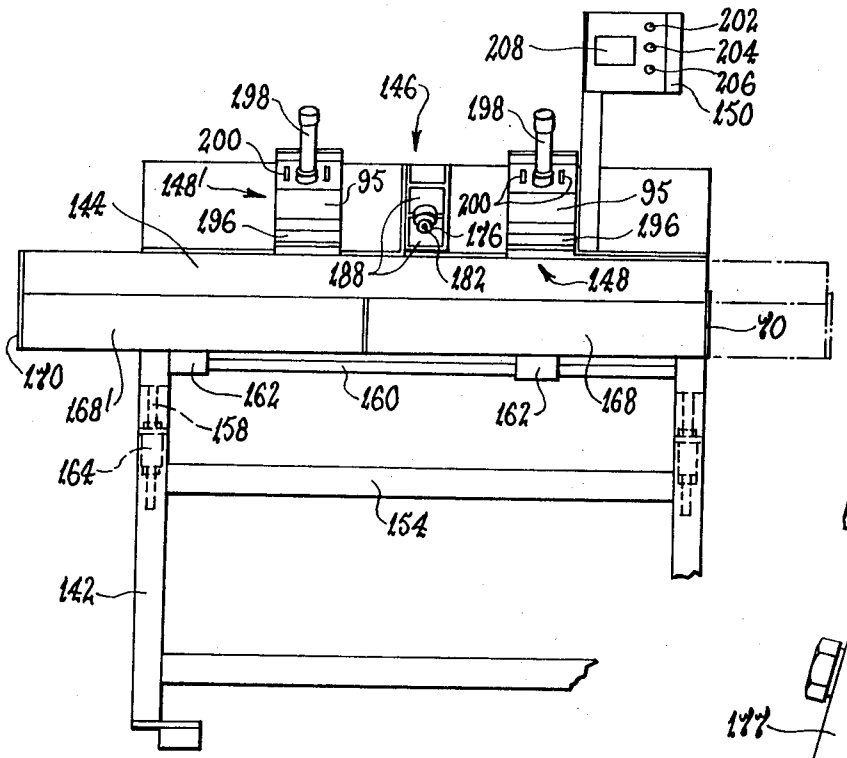

With reference to FIGS. 9 to 11, the features of the apparatus disclosed therein, where similar to those of the apparatus of FIGS. 3 to 5, are identified by the same reference numerals plus 100. As shown, the apparatus 140 has a stand 142 on which is provided platform 144, filling station 146, right and left hand sealing station 148,148', and a control unit 150. Platform 144 is similar to platform 44 of FIGS. 3 to 5, but is of greater length so that stations 146,148,148' are disposed generally centrally over the upper, rear edge thereof.

Platform 144 is mounted in a similar manner to the arrangement of FIGS. 3 to 5. However, the forward mounting assemblies 156 are spaced slightly rearwardly of the front legs of stand 142. This is to enable rods 158 of both the forward and rear assemblies 156, and support blocks 164 for rods 158 to be more widely spaced; thereby fully supporting platform between its left and right extreme positions, respectively shown in solid and broken outline in FIGS. 9 and 11.

Also, across lower, front edge of platform there is provided a right and left hand lip 168,168'; the latter together spanning the full length of that edge. Each of lips 168,168' is separately pivotable from the upstanding position shown to a position in which it provides a continuation of the platform. Also, each of lips 168,168' has at its end remote from the other a bar 170, similar in operation to bar 70 of FIGS. 3 to 5 or FIG. 8, or functionally equivalent thereto, for releasably retaining the respective lip in the position shown.

Station 146, and each of stations 148,148' respectively, may be constructed and operable in the manner described in relation to station 46 and station 48 of apparatus 40. However, in overall operation with apparatus 140, and starting for example with platform 144 to the left extreme position, the opening of an empty first container is fitted to nozzle 176, clamped thereon by operating lever 192, and filled with a predetermined volume of liquid by pressing "fill" button 202. Then, after closing nozzle 176 and releasing that container therefrom, platform 144 is slid to the right extreme position to locate its opening in front of station 148 for sealing. The container opening is positioned in the weld head of station 148 and "weld" button 204 is pressed to initiate sealing of the opening. During sealing of the first container, a second container is presented to station 146 for filling as for the first container. On completion of sealing of the first conainer, it is released from station 148 and, by dropping lip 168, allowed to slide from platform 144 to a conveyor or receiving bin. On release of the first container and also completion of filling of the second container and its release from nozzle 176, platform 144 is returned to its left extreme position to present the second container to station 148' for sealing in like manner to the first container, and disposal by dropping lip 168'. Further containers are successively filled and sealed in a two container cycle, in which the first container is sealed at station 148 and the second at station 148'.

Control unit 150 is operable to control functioning of the components of station 146 and each of stations 148,148'. Control "fill" button 202 is depressed, once lever 192 is operated to secure a container opening on nozzle 176 by blocks 188, thereby energizing a control device to retract piston 182 of nozzle 176 by operation of air cylinder 184. The container is filled with a predetermined volume of liquid, received by nozzle 176 from duct 178, and measured by a flowmeter and magnetic probe in duct 178. As previously, the flowmeter/probe generates a signal or pulses, causing unit 150 to deenergize the control device to close nozzle 176 on filling the container to that volume, and lever 192 is returned to its initial position to open blocks 188. The filled container, held by an operator against discharge of liquid, is slid off nozzle 176 and moved on platform 144 to one of stations 148,148'. On locating the container opening in the weld head of that one station, "weld" button 204 is pressed to energize a control device operable to close the weld head by operation of air cylinder 198 and grip the container opening. Control unit 150 then effects a welding operation across the container opening and, after a predetermined interval, opens the weld head to release the sealed container; cylinder 198 being retracted.

Each of stations 148,148' may be as described above in relation to station 40 of FIGS. 3 to 5. However, it preferably is as shown in FIG. 12; the arrangement of FIG. 12 also being an alternative that can be used in apparatus 40.

Figure 12:
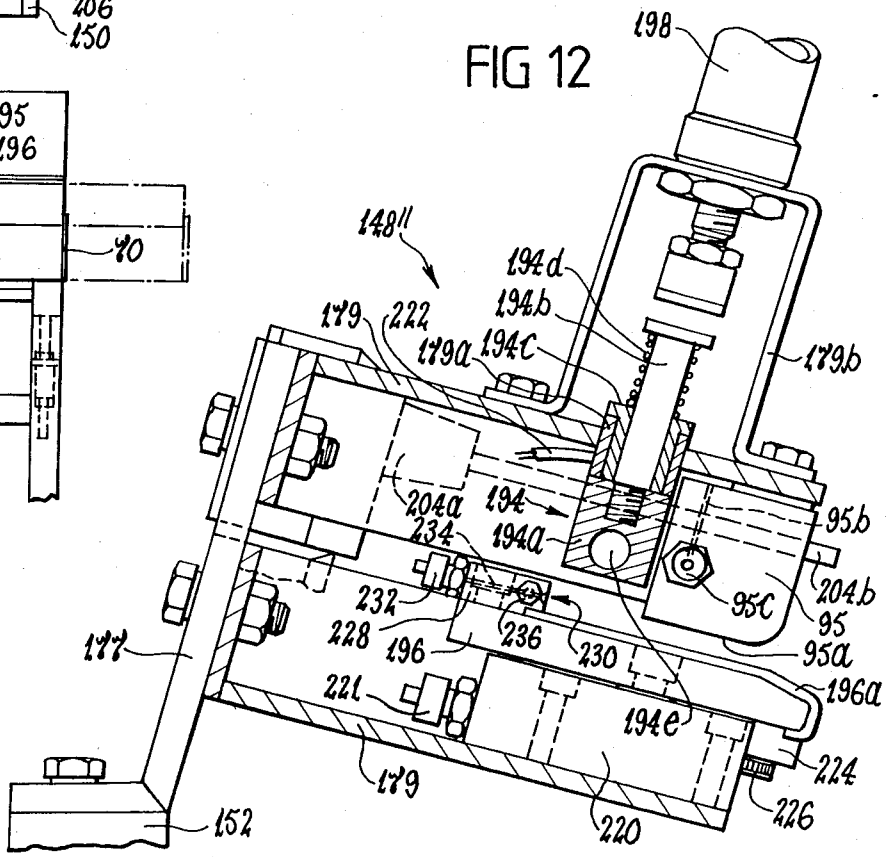
FIG. 12 shows a modified arrangement for one component of the apparatus of FIGS. 3 to 5 or the apparatus of FIGS. 9 to 11.

The sealing station 148" shown in FIG. 12 is adapted to provide constant heat welding, in that electric power for heating the weld head is supplied constantly. In contrast, the arrangement of station 48 of FIGS. 3 to 5 is provided with pulsed or "on demand" power; electric power to heat the weld head being supplied only when the weld head is closed.

Station 148" has a weld head, including a welding block 194 and a pressure block 95 each mounted on upper bracket 179; block 95 being forward of block 194. Opposed to each of blocks 194,95, there is a clamping block 196 mounted on lower bracket 179.

Pressure block 95 is stationary. However, welding block 194 is movable toward and away from block 196 and, for this, has a lower heatable head **194*a* at the lower end of an upwardly extending slide rod 194*b*; the latter being slidable in Teflon bush 194*c* located in collar 179*a* integral with upper bracket 179. A spring 194*d*** biases block 194 to a retracted rest position in which its lower end is slightly above the level of the lower face 95*a* of block 95. Block 194 is movable against the bias of spring 194*d* by cylinder 198; the latter being mounted on upper bracket 179 by rigid strap 179*b*. Block 196 also is movable toward and away from blocks 194,95. For this movement, it is mounted on lower bracket 179 by a shortstroke pneumatic or hydraulic cylinder 220 which receives pressurizing fluid via connector 221.

For sealing, control button 204 of unit 150 is depressed to energize a first control device, such as a solenoid, operable to raise clamping block 196 toward pressure block, by operation of cylinder 220, and grip the container opening between those blocks. A second such control device then is operable to lower sealing block 194 toward clamping block 196, by operation of cylinder 198, and grip the container between those blocks for a predetermined time sufficient to form a seal across that opening. After that time, unit 150 de-energizes the second control device, causing retraction of cylinder 198 and return of block 194 to its rest position under the action of its spring 194*d*. After a predetermined cooling time for the seal formed by block 194, unit 150 de-energizes the first control device, causing release of fluid pressure in cylinder 220, and retraction of block 196 under the action of a return spring in cylinder 220.

Head 194*a* of block 194 is continuously heated by electric power supplied to heating element 194*e* in that head. A thermocouple in head 194*a* is connected to unit 150 by cable 222 to enable unit 150 to monitor the temperature of the head and maintain it within a required temperature range for welding. To minimise heat loss, and also to avoid damage to cylinder 198, the latter retracts to a position spaced from rod 194*b* and contacts the latter only when moving block 194 to, and maintaining it in, its welding position. Also, to minimise heat loss, and also to provide a resilient backing for the container opening for obtaining a uniform seal, block 196 is provided with a resilient, low conductivity, heat-resistant covering 196*a*. The latter amy, for example, be a silicone rubber impregnated fibreglass cloth. Along the forward edge of block 196, covering 196*a* is retained by a rubber clamping strip 224 secured to block 196 by screws 226. Across the rear edge of block 196, covering 196*a* is retained by housing 228 bolted to block 196.

Due to its close proximity to welding block 194, pressure block 95 is prone to radiant heating. To prevent block 95 from being heated to a temperature likely to damage the container, it is provided with cooling means. The latter is shown as comprising a plurality of bores 95*b* extending between its face 95*a* and the remote face, close to and parallel with the face exposed to such radiation. Intermediate their ends, bores 95*b* are interconnected by a transverse bore (not shown), which opens to one side only of block 95. A connector 95*c* communicates with the transverse bore at that side, and is adapted for connection to a source of pressurized air. Control unit 150 maintains a supply of air to connector 95*c* while block 194 is being heated; the air flowing through the transverse bore and discharging through bores 95*b* to maintain block 94 at a low temperature.

It is necessary that a seam newly formed across a container opening be sufficiently cooled and, hence to have gained sufficient strength to avoid rupture during subsequent handling, before release of the container from block 95,196. Natural cooling can be used, but it is preferred to reduce the overall cycle time. Station 148" thus is provided with cooling means; the latter comprising pressurized air jets 230 spaced along the rear edge of block 196 in housing 228. To supply pressurized air, housing 228 has a connector 232 for connection to a source of pressurized gas, connector 232 communicating via bore 234 with a transverse passage (not shown) extending parallel to the rear edge of block 196 and communicating with jets 230. The transverse passage opens to one side only of housing 228, and a needle plug 236 extending into the transverse passage enables adjustment of the air flow discharging from jets 230. As shown, jets 230 are positioned to direct air across the region of block 196 at which block 194 forms a seal, to enable air cooling of the latter on retraction of block 194.

Control unit 150 is operable on retraction of block 194 to energize an air flow control device operable to place connector 232 in communication with a supply of pressurized cooling air, and to de-energize that device after a predetermined seal cooling period. An air service unit 238, mounted at the rear of apparatus 140, can form part of the pressurized air supply system for jets 230. Unit 238 also can form part of that system for cylinder 198 and/or cylinder 220.

As an alternative to air cooling of block 95, the latter may be hollow, or have passageways therethrough, enabling cooling liquid, such as water, to be circulated through that block. In such case, connector 95*c* will be connected to a source of cooling liquid, while a similar connector will be provided on block 95 and connected to a line for discharge of the fluid from that block. A similar liquid cooling arrangement can be provided in the body of block 196.

While in relation to FIG. 12, the foregoing reference to "weld" button 204 of unit 150 is to that button as illustrated, an operator generally will need to use two hands in holding the container opening against loss of liquid, and therefore will be unable simultaneously to reach that button. Accordingly, a microswitch 204*a* is mounted adjacent the welding head and has an elongate actuator stem 204*b* able to be deflected by the operator while holding the container opening with both hands. Microswitch 204*a* is an ancillary to button 204, and deflecting stem 204*b* actuates the abovementioned first control device for extending cylinder 220 and clamping the container opening between blocks 95,196. The arrangement may be such that deflection of stem 204*b* then also brings into operation the above-mentioned second control device to extend cylinder 198, and effect gripping of the opening between blocks 194,196. Alternatively, the arrangement may be such that button 204 has to be pressed by the operator, once the opening is gripped by blocks 95,196 and his hands are free, and he has had an opportunity to check that the placement of the container opening in the weld head is correct. As will be appreciated, a microswitch 204*a*, with elongate stem 204*b*, also can be used in the arrangement of FIGS. 3 to 5.

The flowmeter/probe arrangement in duct 78,178 may be of known form. A WS5/1000 INVALCO turbine flow meter is an example of one suitable unit for this purpose.

Finally, it is to be understood that various alterations, modifications and/or additions may be introduced into the constructions and arrangements of parts previously described without departing from the spirit or ambit of the invention.

What we claim is:

1. Apparatus for packaging a liquid material in bag containers having an opening adjacent an edge of a substantially flat body thereof, comprising a support stand and, mounted thereon, a filling station, a sealing station and support means, said stations being in spaced side by side relation along a horizontally extending line; wherein said support means has a support surface which extends laterally with respect to said line from each of said stations, with said support means being movable backwards and forwards substantially parallel to said line such that successive containers received on said support surface are presented in turn to said filling station and said sealing station; said filling station having a filler head connectable to a source of supply of flowable material and having a nozzle extending laterally, with respect to said line, over said support surface, said nozzle being engageable in the opening of a container received on said support surface for discharge of said material laterally into the container; said filling station further including a pair of jaw members movable between a gripping position, in which they releaseably grip the container opening against the nozzle when the latter is received in said opening, and a retracted position; said sealing station having sealing means being connectable to an electric power source and being operable to grip said opening of a filled container and form a heat seal thereacross; said support surface being closely adjacent said nozzle and sealing means such that the container received on said surface for presentation to said filling station has substantially its entire body extending laterally with respect to said line from said filling station, with said body extending similarly from said sealing means on movement of the support means to present the container to said sealing station.

2. Apparatus according to claim 1, wherein said support means is a support platform movable between respective positions in which a container received thereon is presented in turn to the filling and sealing stations.

3. Apparatus according to claim 2, wherein the support surface of the platform is inclined downwardly away from said stations so as to support the body of the container and the quantity of flowable material therein is below the level of the container opening and below the filler head and sealing means.

4. Apparatus according to claim 3, wherein said platform has a support lip extending along its edge remote from the stations, the support lip being movable between an upstanding position for supporting the container body and a position in which it provides a continuation of the support surface.

5. Apparatus according to claim 2, wherein said frame includes horizontal rails extending in the direction of spacing of said stations, the support means having carriage members engaged with each rail for movement of the support means relative to said stations.

6. Apparatus according to claim 1, wherein said nozzle is of elongate tubular form, a piston being movable axially therein between a position in which it closes an opening of the nozzle against discharge of the flowable material and a retracted position enabling supply of that material to a container.

7. Apparatus according to claim 6, wherein said piston is movable between said positions under the action of a pneumatic or hydraulic actuator.

8. Apparatus according to claim 1, wherein said sealing means has a pair of gripping blocks between which the container opening is receivable and relatively movable between a gripping position and a retracted position, one of said blocks being heatable by said electric power source for forming a heat seal across a container opening received therebetween.

9. Apparatus according to claim 8, wherein said blocks are relatively movable to said gripping position under the action of a pneumatic or hydraulic actuator.

10. Apparatus according to claim 1, including control means operable to control operation of said filling and sealing stations.

11. Apparatus according to claim 1, wherein said filling station includes a conduit connectable to said source of flowable material and through which said material passes for discharge to the container, said conduit having flow measuring means, and wherein said apparatus includes control means operable to control operation of said filling and sealing stations, said control means including monitoring means responsive to operation of said measuring means and generating a signal for terminating discharge of flowable material to the container when the latter is filled with a pre-determined said quantity of that material.

12. Apparatus according to claim 1, wherein said support means is a support platform movable between respective positions in which a container received thereon is presented in turn to the filling and sealing stations, the support surface of the platform being inclined downwardly away from said stations so as to support the body of the container and the quantity of flowable material therein below the level of the container opening and below the filler head and sealing means, said platform having a support lip extending along its edge remote from the stations and being movable between an upstanding position for supporting the container body and a position in which it provides a continuation of the support surface; the filler head comprising a nozzle of elongate tubular form and a piston movable axially therein between a position in which it closes an opening of the nozzle against discharge of the flowable material and a retracted position enabling supply of that material to a container, and the filling station including a pair of jaw members between which the nozzle extends, the jaw members being movable between a gripping position and a retracted position; and wherein said sealing station has a pair of gripping blocks between which the container opening is receivable and relatively movable between a gripping position and a retracted position, one of said blocks being heatable by said electric power source for forming a heat seal across a container opening received therebetween.

13. Apparatus according to claim 1, wherein said sealing station has a pair of gripping blocks between which the container opening is receivable, said blocks being relatively movable between a gripping position and a retracted position; the sealing station further including a third block positioned adjacent one of the blocks of said pair and movable relative to the other block between a gripping position in which it and said other block grip the container opening and a retracted position; the third block being heatable by said electric power source for forming a heat seal across said container opening.

14. Apparatus according to claim 13, wherein a first actuator is operable to move said pair of blocks to their gripping position to grip a container opening therebetween, after which a second actuator is operable to move said third block relative to the other block to bring those blocks into their gripping position for forming said seal; the respective actuator being operable in the reverse order to return the blocks to their relative retracted positions.

15. Apparatus according to claim 14, wherein said sealing station includes seal cooling means, the cooling means being operable to supply cooling gas receivable from a source thereof to a newly formed seal between operation of the second and then the first actuator to return the blocks to their relative retracted positions.

16. Apparatus for packaging a flowable material in bag containers, comprising a support stand and mounted thereon, a filling station, two sealing stations, and support means, said stations being in spaced, side by side relation with said filling station intermediate said sealing stations; the support means having a support surface on which successive containers are receivable, and movable relative to said stations from a position in which a container received thereon can be presented in turn to said filling station and a respective said sealing station; the filling station having a filler head connectable to a source of supply of the flowable material and engageable with an opening of successive containers for discharge of a quantity of said material into the container; each sealing station having sealing means for receiving the opening of alternate filled containers, said sealing means being connected to an electric power source and being operable to grip said opening and form a heat seal thereacross.

17. Apparatus according to claim 16, wherein said support means is a support platform movable between a filling position in which successive containers received thereon are presented to the filling station, and respective sealing positions in which alternate filled containers are presented to the sealing stations, the support surface of the platform being inclined downwardly away from said stations so as to support the body of the container and the quantity of flowable material therein is below the level of the container opening and below the filler head and sealing means, said platform having two support lip portions extending in end to end relation along its edge remote from the stations and each separately movable between an upstanding position for supporting the container body and a position in which it provides a continuation of the support surface; the filler head comprising a nozzle of elongate tubular form and a piston movable axially therein between a position in which it closes an opening of the nozzle against discharge of the flowable material and a retracted position enabling supply of that material to a container, and the filling station including a pair of jaw members between which the nozzle extends, the jaw members being movable between a gripping position and a retracted position; and wherein each said sealing station has a pair of gripping blocks between which a respective container opening is receivable and relatively movable between a gripping position and a retracted position, one of said blocks being heatable by said electric power source for forming a heat seal across a container opening received therebetween.

18. Apparatus according to claim 16, wherein said support means is a support platform movable between a filling position in which successive containers received thereon are presented to the filling station, and respective sealing positions in which alternate filled containers are presented to the sealing stations.

19. Apparatus according to claim 18, wherein the support surface of the platform is inclined downwardly away from said stations so as to support the body of the container and the quantity of flowable material therein is below the level of the container opening and below the filler head and sealing means.

20. Apparatus according to claim 19, wherein said platform has two support lip positions extending in end to end relation along its edge remote from the stations, each support lip portion being separately movable between an upstanding position for supporting the container body and a position in which it provides a continuation of the support surface.

21. Apparatus according to claim 16, wherein said frame includes horizontal rails extending in the direction of spacing of said stations, the support means having carriage members engaged with said rail for movement of the support means relative to said stations.

22. Apparatus according to claim 16, wherein the filler head comprises a filler nozzle on which the container opening is receivable, the filling stationing including gripping means operable to releasably grip the container opening against the nozzle.

23. Apparatus according to claim 22, wherein the means comprises a pair of jaw members between which the nozzle extends, the jaw members being movable between a gripping position and a retracted position.

24. Apparatus according to claim 22, wherein said nozzle is of elongate tubular form, a piston being movable axially therein between a position in which it closes an opening of the nozzle against discharge of the flowable material and a retracted position enabling supply of that material to a container.

25. Apparatus according to claim 24, wherein said piston is movable between said positions under the action of a pneumatic or hydraulic actuator.

26. Apparatus according to claim 16, wherein each said sealing station has a pair of gripping blocks between which a respective container opening is receivable and relatively movable between a gripping position and a retracted position, one of said blocks being heatable by said electric power source for forming a heat seal across a container opening received therebetween.

27. Apparatus according to claim 26, wherein said blocks are relatively movable to said gripping position under the action of a pneumatic or hydraulic actuator.

28. Apparatus according to claim 16, including control means operable to control operation of said filling and sealing stations.

29. Apparatus according to claim 16, wherein said filling station includes a conduit connectable to said source of flowable material and through which said material passes for discharge to the container, said conduit having flow measuring means, and wherein said apparatus includes control means operable to control operation of said filling and sealing stations, said control means including monitoring means responsive to operation of said measuring means and generating a signal for terminating discharge of flowable material to the container when the latter is filled with a pre-determined said quantity of that material.

30. Apparatus accoding to claim 16, wherein each said sealing station has first and second gripping blocks between which the container opening is receivable, said blocks being relatively movable between a gripping position and a retracted position; the sealing station further including a third block positioned adjacent said first block of said pair and movable relative to said second block between a gripping position in which said second and third block grip the container opening and a retracted position; the third block being heatable by said electric power source for forming a heat seal across said container opening.

31. Apparatus according to claim 30, wherein a first actuator is operable to move said first and second blocks to their gripping position to grip a container opening therebetween, after which a second actuator is operable to move said third block relative to said second block to bring said second and third blocks into their gripping position for forming said seal; the respective actuator being operable in the reverse order to return the blocks to their relative retracted positions.

32. Apparatus according to claim 31, wherein said sealing station includes seal cooling means, the cooling means being operable to supply cooling gas receivable from a source thereof of a newly formed seal between operation of the second actuator to return the second and third blocks to their relative retracted positions and operation of the first actuator to return the first and second blocks to their relative retracted positions.

33. A method of packaging a flowable material in bag containers having an opening adjacent an edge of a substantially flat body thereof, including the steps of presenting successive containers in turn to a support surface of a filling means at a filling station at which a container filling operation is to be performed; thereafter moving the containers in turn from said station to a sealing station at which a sealing operation is to be performed by moving said support means parallel to a line along which said stations are horizontally spaced in side by side relation; wherein said method further includes the steps for each container in turn of engaging the opening of the container over a filler head nozzle at said filling station which nozzle extends laterally with respect to said line over said surface, releasably gripping the opening on said nozzle by actuating jaw members, discharging into the container from the nozzle a quantity of said material received by the filler head from a source thereof, deactuating said jaw members to release the opening from said nozzle, moving the support means and the filled container thereon to said sealing station, presenting the opening to sealing means of said sealing station, actuating said sealing means to form a heat seal across said opening, and actuating the sealing means to release the sealed and filled container; said steps being characterized by maintaining said container at said filling and sealing stations, and, during movement from the former to the latter station, with substantially the entirety of its body extending laterally from said stations on said surface with respect to said line.

34. A method according to claim 33, wherein actuating said sealing means to form said heat seal is performed by moving gripping blocks to grip the container opening, and energizing heating means of one of said blocks, the sealing means being actuated to release the sealed and filled container by retracting said blocks.

35. A method according to claim 33, further characterized by moving alternate ones of successive filled containers from the filling station to a respective one of two sealing stations between which said filling station is located.

* * * * *